US006651476B2

(12) United States Patent
Nordlof

(10) Patent No.: US 6,651,476 B2
(45) Date of Patent: Nov. 25, 2003

(54) COMBINED COIL-STOCK STRAIGHTENING AND FEED APPARATUS

(75) Inventor: Richard D. Nordlof, Rockford, IL (US)

(73) Assignee: Mechanical Tool & Engineering Co., Rockford, IL (US)

( * ) Notice: Subject to any disclaimer, the term of this patent is extended or adjusted under 35 U.S.C. 154(b) by 0 days.

(21) Appl. No.: 09/975,577

(22) Filed: Oct. 10, 2001

(65) Prior Publication Data

US 2003/0066327 A1 Apr. 10, 2003

(51) Int. Cl.[7] ..... B21D 1/02
(52) U.S. Cl. ..... 72/164
(58) Field of Search ..... 72/160, 164, 165

(56) References Cited

U.S. PATENT DOCUMENTS

| | | | | |
|---|---|---|---|---|
| 4,304,348 A | | 12/1981 | Kato | |
| 4,380,921 A | * | 4/1983 | Matsui | 72/165 |
| 4,594,872 A | | 6/1986 | Nordlof | |
| 4,669,645 A | | 6/1987 | Nordlof | |
| 4,759,485 A | | 7/1988 | Braun et al. | |
| 5,033,342 A | | 7/1991 | Nordlof | |
| 5,072,872 A | | 12/1991 | Casset et al. | |
| 5,102,026 A | | 4/1992 | Messner | |
| 5,150,022 A | | 9/1992 | Waddington | |
| 5,163,595 A | | 11/1992 | Messner | |
| 5,184,492 A | * | 2/1993 | Ushigami | 72/160 |
| 5,197,645 A | | 3/1993 | Nordlof | |
| 5,305,938 A | | 4/1994 | Nordlof | |
| 5,761,978 A | | 6/1998 | Nordlof | |
| 5,772,095 A | | 6/1998 | Nordlof | |
| 5,794,664 A | | 8/1998 | Hasegawa et al. | |
| 5,868,296 A | | 2/1999 | Gentile et al. | |
| 5,913,470 A | | 6/1999 | Scribner | |
| 5,961,022 A | | 10/1999 | Pfeiffer et al. | |
| 5,992,722 A | | 11/1999 | Strick et al. | |

FOREIGN PATENT DOCUMENTS

| | | | | |
|---|---|---|---|---|
| JP | 56-136516 | * | 10/1980 | 72/160 |
| JP | 3-18426 | * | 1/1991 | 72/164 |
| JP | 5-317965 | * | 12/1995 | 72/164 |
| SU | 478674 | * | 7/1975 | 72/160 |

* cited by examiner

*Primary Examiner*—Daniel C. Crane
(74) *Attorney, Agent, or Firm*—Keith Frantz

(57) ABSTRACT

A roll-type straightening and feed mechanism includes opposing sets of straightening rolls adapted to straighten coil stock as it travels therebetween, opposing feed rolls adapted to grip the coil stock therebetween to advance the straightened coil stock to a using station, and operators connected to simultaneously separate the straightening rolls and the feed rolls and release the coil stock therebetween, and to simultaneously reset the straightening rolls and the feed roll and re-grip the coil stock for advancing straightened stock.

13 Claims, 12 Drawing Sheets

COMBINED COIL-STOCK STRAIGHTENING AND FEED APPARATUS

CROSS-REFERENCES TO RELATED APPLICATIONS none.

REFERENCE TO MICROFICHE APPENDIX not applicable.

STATEMENT REGARDING FEDERALLY SPONSORED RESEARCH OR DEVELOPMENT not applicable.

BACKGROUND OF THE INVENTION

1. Field of Invention

The present invention relates generally to apparatus for straightening coil stock, and then feeding the straightened coil stock to a using station.

More particularly, the invention relates to apparatus provided with both straightening and feed rolls that are adapted to simultaneously engage the coil stock during material demand by the using station, and to simultaneously release the coil stock in the absence of material demand from the using station, and which, while suitable for other uses, is particularly useful in intermittently feeding coil stock to a punch press for ease of final positioning of the stock in the press.

2. Description of Prior Art

A conventional punch press line adapted to punch parts from coiled strip stock includes a reel that holds the coiled stock, a stock straightening mechanism that straightens the stock as it is drawn off the reel, and a feed mechanism that draws the stock from the straightener and feeds the straightened stock to the punch press.

A conventional coil stock feed mechanism includes a set of power-rotated feed rollers between which the strip stock is gripped, to pull the stock from the straightener and feed the stock to the punch press. For use with a punch press, the feed rolls are operative to alternately advance the stock in a selected length increment to the press, and then release the stock during the each punch cycle of the press.

A conventional coil stock straightening mechanism includes two sets of rollers between which the stock travels in a wave such that the stock cyclically flexes in alternating directions as it travels therethrough.

Precision stamping of strip stock requires the stock to be precisely positioned in the punch press during each punch cycle. This precision positioning is typically accomplished by punching a pilot hole in the stock at a first station, and actuating a tapered pilot pin at a second station through a pilot hole that was punched at the first station during a preceding press cycle for final positioning of the stock at the second station prior to punching of the desired part. During each cycle, the stock is feed into the punch press approximately one to two thousandths (0.001–0.002) inch short of the desired position by the feed mechanism, the feed mechanism releases the stock, and the tapered pilot pin draws the stock the additional 0.001–0.002 inch into the desired final position. After the desired part has been punched, the pilot pin is withdrawn, and the feed mechanism re-engages the stock to feed stock for the next cycle. Thus, operation of the feed mechanism is controlled in cyclic synchronization with the pilot pin operation of the punch press, or some other type of position control associated with the cyclic operation of the press.

Traditionally, the straightener and feed mechanisms are provided in separate units, with a loop of the coil stock therebetween. This loop of stock accommodates the difference in feed characteristics of the continuously acting straightener and the intermittently pulling feed mechanism. One such conventional arrangement is generally shown in Waddington U.S. Pat. No. 5,150,022.

In certain instances, the straightener and feed mechanisms have been combined into a single unit. This provides advantages including the elimination of the loop of material and an associated reduction of floor space requirements. The combined unit also simplifies set-up and control of the entire straightening and feeding process because the straightened material moves directly from the straightening rolls into the feed rolls and then into the die area of the punch press.

However, prior combined roll-type straightener and feed mechanisms present certain difficulties as regards the final positioning of the stock in the punch press. With the elimination of the loop of material, the integrated straightening mechanism resists movement of the stock into its final position as a result of the continuous tension applied to the stock by the straightener rolls. As a result, the pilot mechanism in the punch press must be adapted to overcome this tension as it pulls the stock into final position. Consequently, presses set-up for use with a combined straightener and feed mechanism typically experience wear of the pilot pin at an increased rate distortion of the material being fed, and are subject to loss in final positioning accuracy at a faster rate as compared with presses that are fed by a conventional feed mechanism that is separated from the straightening mechanism. Another drawback of prior combined straightening and feed mechanisms is that they are subject to loss in roll position and overall feed length accuracy.

Thus, it is apparent that there is a need for a combined straightening and feed mechanism that provides the benefits, but eliminates the above-identified disadvantages associated with prior combined straightening and feed mechanisms.

SUMMARY OF THE INVENTION

The general aim of the present invention is to provide new and improved combined feed and straightening apparatus adapted to feed precisely controlled length increments of coiled strip stock to a punch press in synchronization with the final positioning control system of the press, and which eliminates the continuously acting straightening roller tension on the stock of prior apparatus of the same general type.

A detailed objective is to achieve the foregoing by providing feed rollers and straightening rollers that simultaneously engage the strip material for straightening and advancing a length of stock to the punch press during a material demand cycle, and that simultaneously release the material at the end of each material demand cycle for final positioning in the press.

These and other objectives and advantages of the invention will become more apparent from the following detailed description when taken in conjunction with the accompanying drawings.

Briefly, a combined coil stock feed and straightening device includes a pair of feed rollers located on opposite sides of a feed path along which the strip stock is guided, and two sets of straightening rollers upstream of the feed rollers on opposite sides of the feed path.

Incremental movement of the coil stock through the device is accomplished by power rotating the feed rollers while the strip material is clamped therebetween, and stopping and separating the feed rollers to stop further powered movement of the strip material during operation of the punch press. The straightening rollers are adapted to separate from the coil stock simultaneously with the feed rollers for ease of final positioning of the stock in the press.

In preferred embodiments, one of the feed rollers is rotated on a fixed axis in relation to the feed path, and the other feed roller is moveable toward and away from the fixed feed roller between a material gripping position and a material release position. Similarly, one of the sets of straightening rollers rotate on fixed axes in relation to the feed path, and the other set is movable toward and away from the fixed set for movement between a material engaging-straightening position and a material release position.

A pair of operators, responsive to fluidic control signals, effect synchronized movement of the movable feed roller and the movable set of straightening rollers between said positions, and associated pilot release valves are operable to supply the fluidic control signals in response to material demand signals from the punch press.

Figure 1:
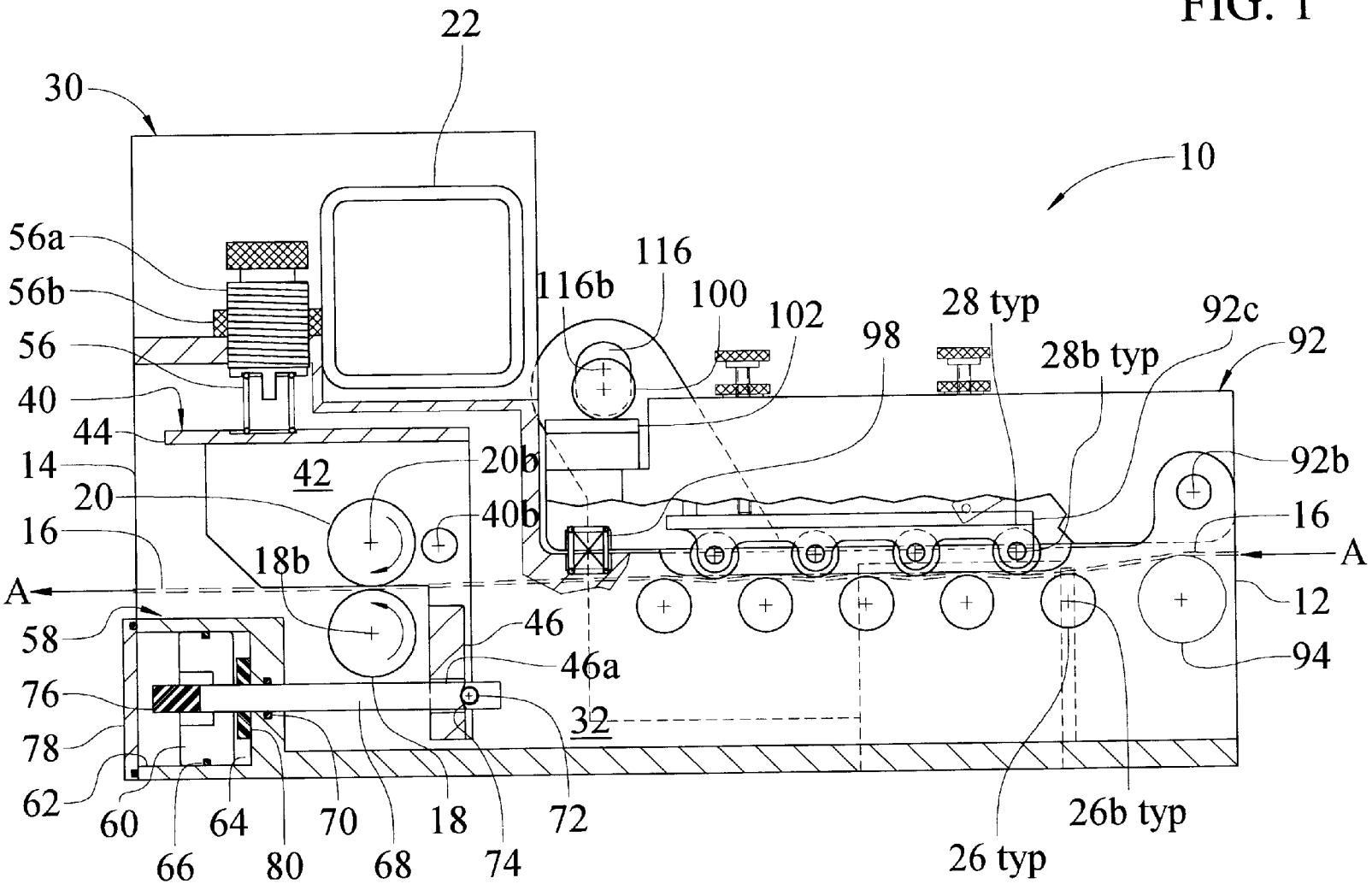
FIG. 1 is a left side cross-sectional view taken substantially through the center of a combined coil stock straightening and feed apparatus incorporating the unique aspects of the present invention, the apparatus being shown in its material gripping condition, for straightening and feeding coil stock to a using station.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

Reference numerals shown in the drawings correspond to the following items:

10—combined straightening and feed device
12—upstream end of device 10
14—downstream end of device 10
16—strip stock
18—lower drive feed roller
18*a*—bearings supporting lower drive feed roller
18*b*—rotational axis of lower drive feed roller
20—upper pinch feed roller
20*a*—bearings supporting upper drive feed roller
20*b*—rotational axis of upper drive feed roller in material gripping condition
20*b*'—rotational axis of upper drive feed roller in material release condition
22—rotary drive unit
24—output shaft of drive unit
26—fixed straightening rollers
26*a*—bearings supporting fixed straightening rollers
26*b*—rotational axes of fixed straightening rollers
28—movable straightening rollers
28*a*—bearings supporting movable straightening rollers
28*b*—rotational axes of movable straightening rollers
30—casing/rigid frame structure
32—fixed side supports
34—drive belt
36—pulley on lower drive unit
38—pulley on drive unit output shaft
40—bracket
40*a*—bearings supporting bracket
40*b*—rotational axes of bracket
42—sidewalls of bracket
44—connecting member
46—tail section
46*a*—hole in tail section
48—gear of lower feed roll
50—gear of upper feed roll
52—idler gear
54—idler gear
56—spring assembly
56*a*—adjustable spring retainer
56*b*—lock nut
58—actuator
60—piston
62—piston bore
64—air chamber
66—piston seal
68—piston rod
70—rod seal
72—pin
74—radius profile
76—rubber stop
78—actuator cap
80—rubber stop
84—gear
86—gear
88—gears
90—gears
92—platen
92*a*—bearings supporting platen
92*b*—pivoting axis of platen
92*c*—bracket
94—entrance guide roller
94*a*—adjustable edge guides
96—actuator

97—actuator cap
98—springs
98*a*—counterbore
100—cam
102—wear plate
104—piston
106—piston bore
108—piston seal
110—piston rod
112—rack
114*a*—gear
114*b*—gear
114*c*—gear
116—drive shaft
118—air chamber
120—rubber stop
122—rubber stop
124—air pilot valve
126—air pilot valve
128—control unit module
130—air pressure supply
132—control signals from punch press
A—A—feed path of strip stock 16

DETAILED DESCRIPTION OF THE INVENTION

For purposes of illustration, the present invention is shown in the drawings as a combined material feed and straightening device 10 (FIG. 1) adapted to incrementally feed precise lengths of straightened continuous strip material 16 along a feed path A—A from a supply coil to a punch press in synchronization with the final positioning arrangement of the press.

Briefly, the device 10 includes a casing or rigid frame structure generally indicated as 30 having fixed side supports generally indicated as 32 that extend lengthwise between upstream and downstream ends 12 and 14 on each side of the feed path A—A; a pair of feed rollers 18 and 20 operatively coupled to a rotary drive unit 22 for advancing the strip material 16 along the feed path; and two sets of straightening rollers 26 and 28 adapted to effect straightening of the material as it travels through the device.

Figure 2:
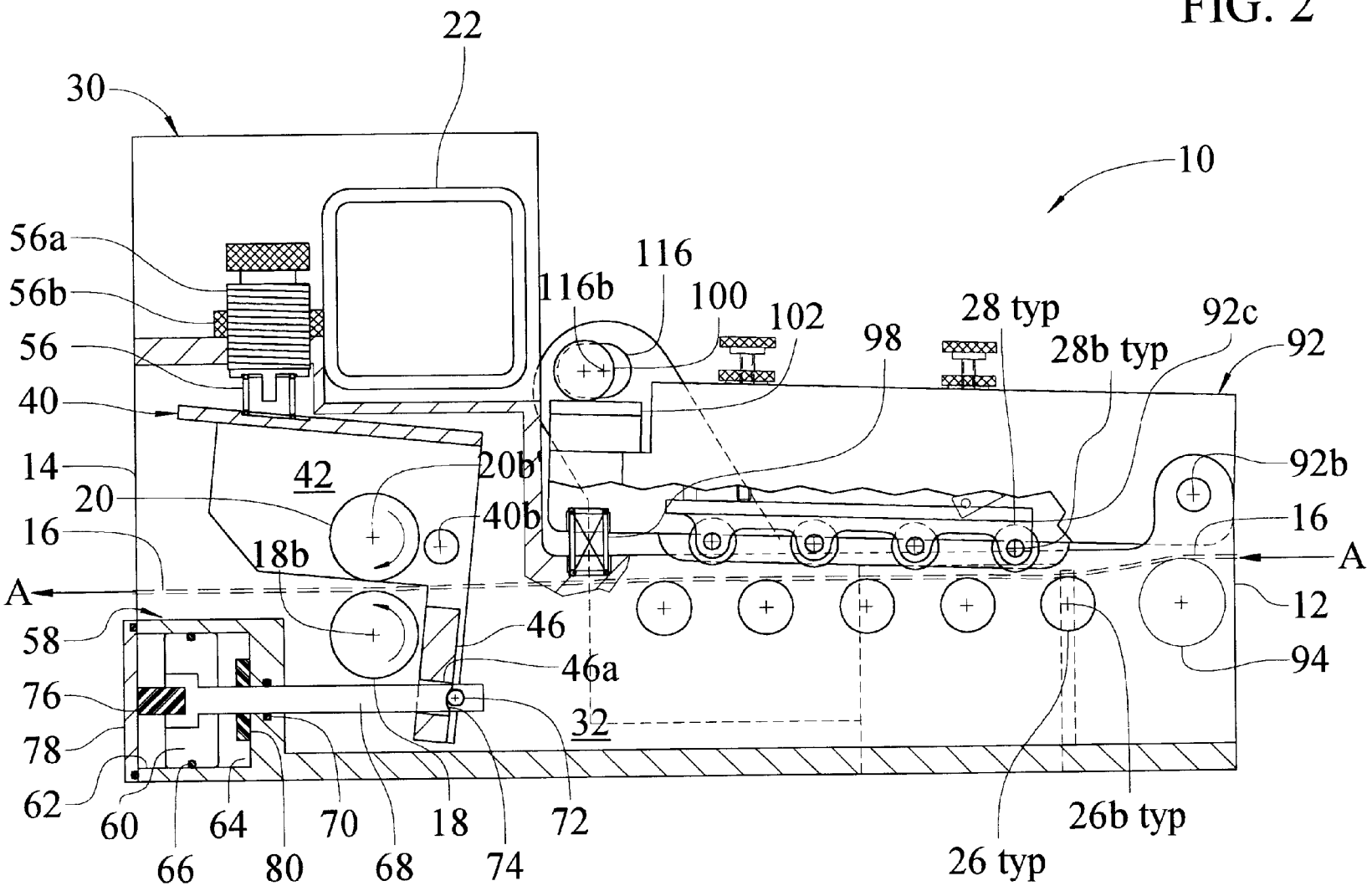
FIG. 2 is a view similar to FIG. 1, but with the apparatus shown in its material release condition.

The feed rollers 18 and 20 are located on opposite sides of the feed path A—A proximate the downstream end 14, are mounted for rotation about parallel axes 18*b* and 20*b* extending transversely to the feed path, and comprise (i) a lower drive feed roller 18 mounted in fixed relation to the casing 30, and (ii) an upper pinch feed roller 20 operably connected to a pneumatic operator 58 for movement between (a) a material gripping position (as shown in FIG. 1) cooperative with the lower drive feed roller for gripping the strip material 16 therebetween and advancing the material toward the punch press in response to a control or feedback signal from the press during a material demand cycle, and (b) a material release position (as shown in FIG. 2) spaced from the strip material in response to a second signal from the press indicating the end of the material demand cycle.

The straightening rollers 26 and 28 are located on opposite sides of the feed path A—A upstream of the feed rollers 18 and 20, are mounted for rotation about axes 26*b* and 28*b* parallel to the feed rollers, and comprise (i) a lower set of straightening rollers 26 mounted in fixed relation to the casing 30, and (ii) an upper set of straightening rollers 28 operably connected to a second pneumatic operator 96 for synchronized movement with the upper feed roller 20 between (a) a material engaging position (FIG. 1) cooperative with the lower straightening rollers for straightening the strip material 16 prior to reaching the feed rollers during the material demand cycles of the punch press, and (b) a material release position (FIG. 2) spaced from the strip material between the material demand cycles.

In the embodiment shown, the lower drive feed roller 18 is journaled between the side supports 32 of the casing 30 in bearings 18*a* (FIG. 3) for rotation about axis 18*b* below the feed path A—A. The output shaft 24 of drive unit 22 is coupled for rotation of the lower feed roller such as with gears or a chain, and in the embodiment shown through a drive belt 34 connected between pulleys 36 and 38 provided at the ends thereof (see FIGS. 5 and 7). Suitable drive units include, but are not limited to brushless AC servomotors and stepper motors, such as provided with a resolver adapted to provide a closed-loop roller position feedback signal for use by the system controller.

The upper pinch feed roller 20 is journaled in bearings 20*a* (FIG. 3) between laterally spaced side walls 42 of a bracket 40 for rotation about axis 20*b* above the feed path, and is journaled with respect to the casing 30 for limited pivoting toward and away from the lower feed roller. In this instance, the bracket is journal mounted between the side supports 32 about an axis 40*b* above the feed path A—A and parallel to but spaced transversely of the axes 18*b* and 20*b* for swinging between (i) a lower position (FIG. 1)in which the upper feed roller is in gripping engagement with the strip material 16 located in the feed path, and (ii) a raised position (FIG. 2) in which the upper feed roller is spaced from the strip material in the feed path. The bracket shown includes a generally horizontal upper section 44 connecting the side walls 42, and a generally vertical tail section 46 depending therebetween at a position below the lower drive feed roller 18.

Figure 3:
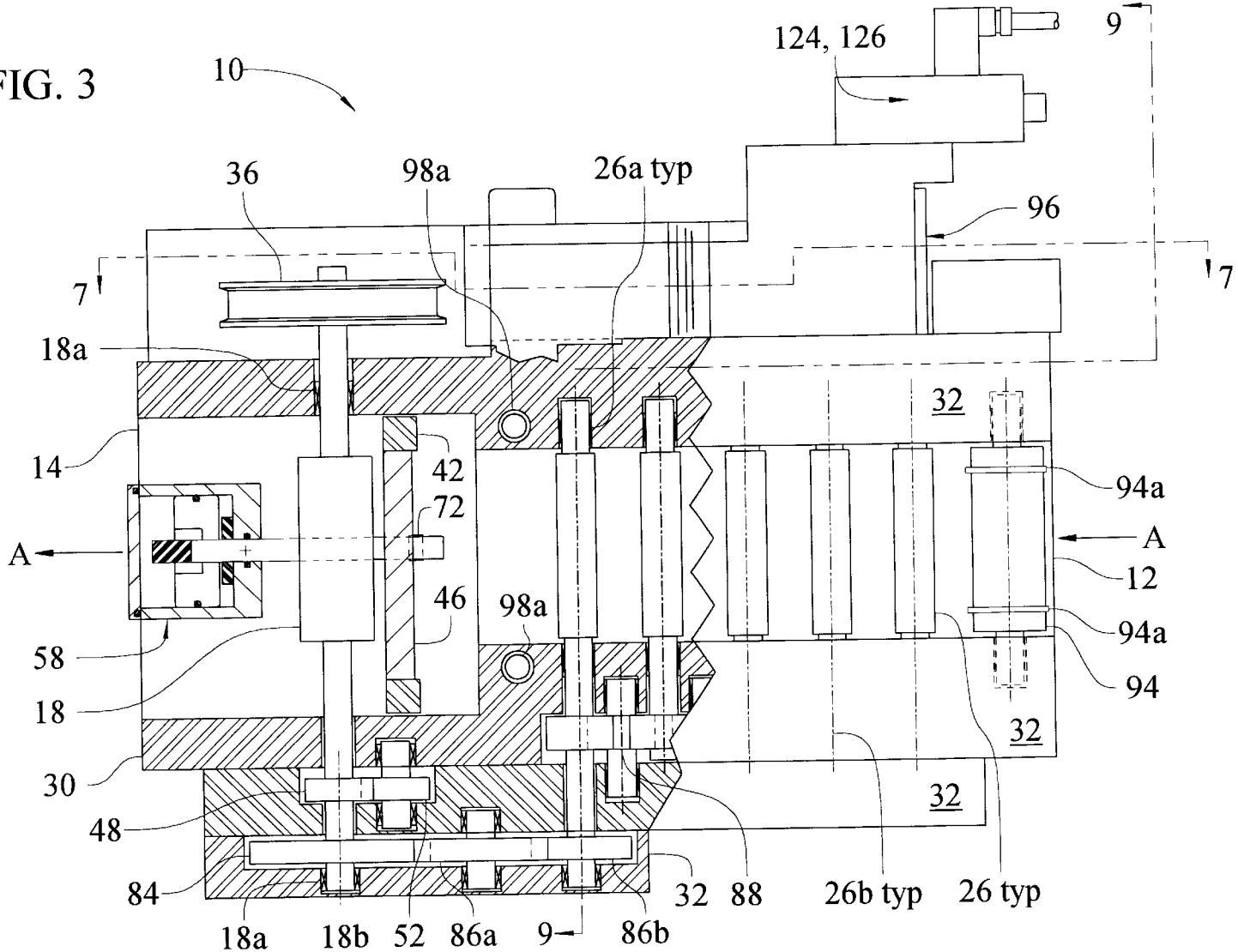
FIG. 3 is a top view taken substantially along the line 3—3 of FIG. 6.
Figure 4:
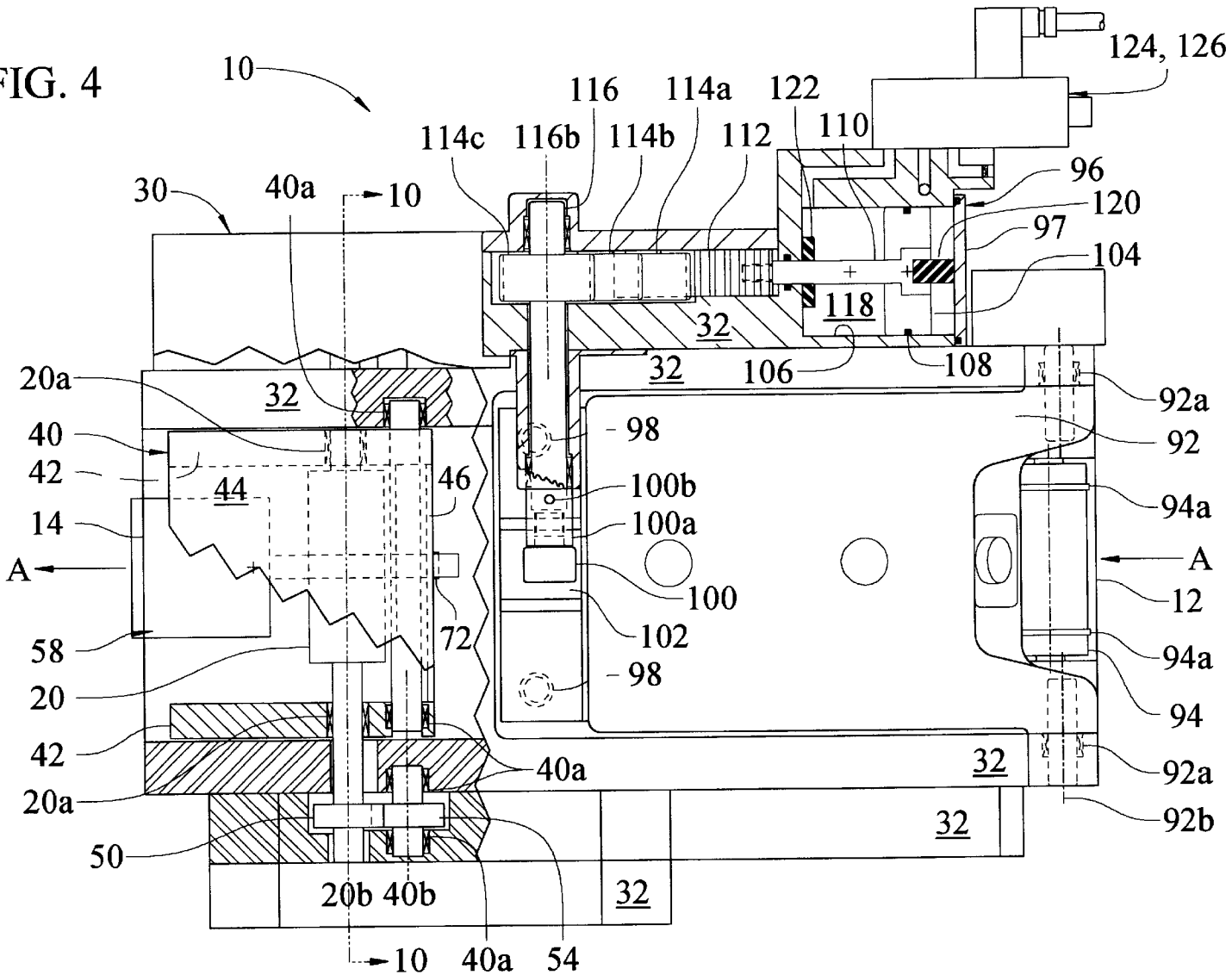
FIG. 4 is a top view taken substantially along the line 4—4 of FIG. 6, with certain parts broken away and shown in cross-section, and with the apparatus shown in its material gripping condition.
Figure 6:
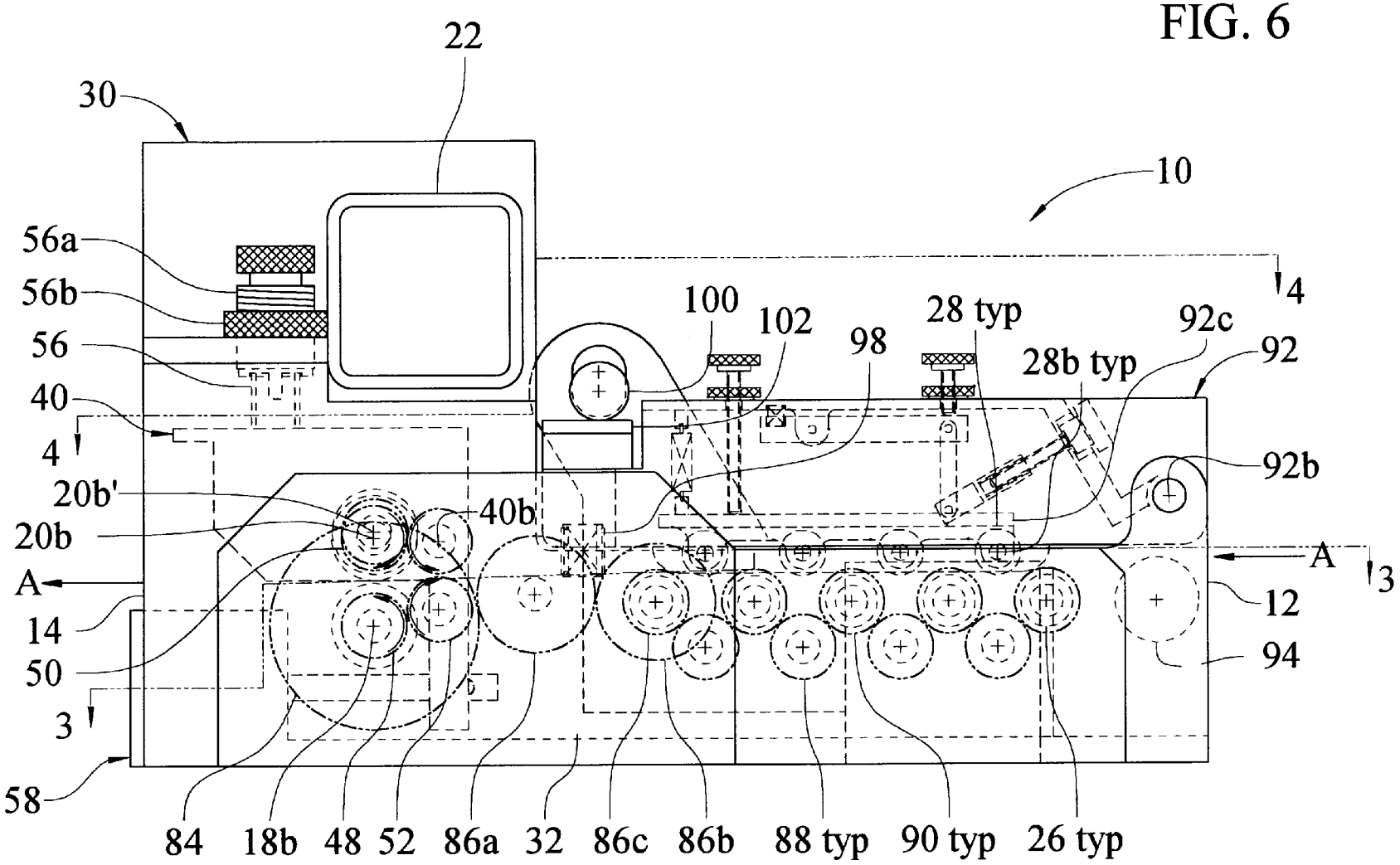
FIG. 6 is a left side view showing certain gear-drive and other internal components in dashed lines.

The upper feed roller 20 is rotationally coupled to the lower feed roller 18 by gears 48 and 50 connected through idler gears 52 and 54 that are rotatably supported on idler shafts carried by the casing 30 (see FIGS. 3, 4 and 6). The gears 48, 50, 52 and 54 are provided with the same pitch diameter so that the feed rollers rotate at the same speed but in opposite angular directions as indicated. Thus, when the upper feed roller is in its material gripping position (FIG. 1), the drive unit 22 power rotates both feed rollers for advancing a length of the strip material 16 passing therebetween toward the punch press. Advantageously, idler gear 54 rotates about the journal mounting axis 40*b* such that, as the bracket pivots about the same axis 40*b*, the gear 50 connected to upper feed roller rotates about the center of, and rolls along the idler gear 54 to maintain full engagement therebetween.

As shown in FIG. 1, the upper feed roller 20 is spring biased into its material gripping position by spring 56, and pneumatically actuated to the material release position (FIG. 2) by pneumatic actuator 58. To that end, spring 56 is grounded to the casing 30 and positioned to engage the bracket 40 oppositely of the journal mounting axis 40*b* with respect to the pinch roller axis 20*b* to continuously bias the bracket toward its lower position, and the actuator 58 is connected to the tail section 46 of the bracket oppositely of the journal mounting axis 40*b* with respect to the feed path A—A for rotation of the bracket from its lower position to its upper position in contravention to the resilient biasing force of the spring. An adjustable spring retainer 56*a* threaded through the casing 30 and locked into position with a threaded nut 56*b*, permits manual adjustment of the spring-bias gripping force between the feed rollers.

The linear pneumatic actuator 58 includes a piston 60 slidably located in a piston bore 62 defined within the casing 30 and pneumatically responsive for linear movement therein to pressure in air chamber 64 defined in the piston bore; a piston seal 66 positioned to establish a sliding, sealing engagement between the piston and the piston bore; and a piston rod 68 that extends through a rod seal 70 and that is operatively connected at its free end to the tail section 46 of the bracket 40. In this instance, the piston rod extends slidably through a hole 46*a* in the tail section of the bracket, and a pin 72 located in a cross-hole in the piston rod maintains the piston rod in position therein. A radius-profile 74 formed in the tail section provides a relatively low-friction, automatically centering interface with the outer cylindrical profile of the pin. For actuation stability, the actuator is aligned with the lateral center of the bracket for connection to the center of the tail section (see FIG. 3).

With this arrangement, as air pressure is supplied to chamber 64, the piston 60 strokes in a direction away from the tail section 46 (to the left as shown in FIGS. 1 and 2), and the pin 72 engages and draws the tail section 46 with the piston, pivoting the bracket 40 toward its raised position (clockwise as shown in FIGS. 1 and 2) and the upper feed roller 20 toward its material release position, until a rubber stop 76 engages against the actuator cap 78 (FIG. 2).

As air pressure is relieved from the chamber 64, the bias force of spring 56 rotates the bracket 40 towards it lower position (counter-clockwise as shown) and the upper feed roller 20 toward the lower feed roller 18 and into gripping engagement with the strip material 16 therebetween. As the bracket rotates, the tail section acts against the pin 72 to return the piston to its extended position (FIG. 1). A second rubber stop 80 is optionally provided in the actuator chamber 64 to cushion the return stroke of the piston, and to reduce the volume of the chamber without affecting the pressure responsive area of the piston for relatively short actuator response time characteristics.

The lower straightening rollers 26 are journaled between the side supports 32 of the casing 30 in bearings 26*a* (FIG. 3) for rotation about axes 26*b* below the feed path A—A. The lower straightening rollers are rotated by the drive unit 22 through a gear train comprising a gear 84 that is connected for rotation with the lower feed roller 18 and that drives gears 86*a* and 86*b*, the latter of which is connected via a common shaft to gear 86*c* which, in turn, drives idler gears 88 journaled in the side supports 32 on idler shafts and gears 90 connected to ends of the lower straightening rollers engaging the idler gears (see FIGS. 3, 6 and 8).

Figure 9:
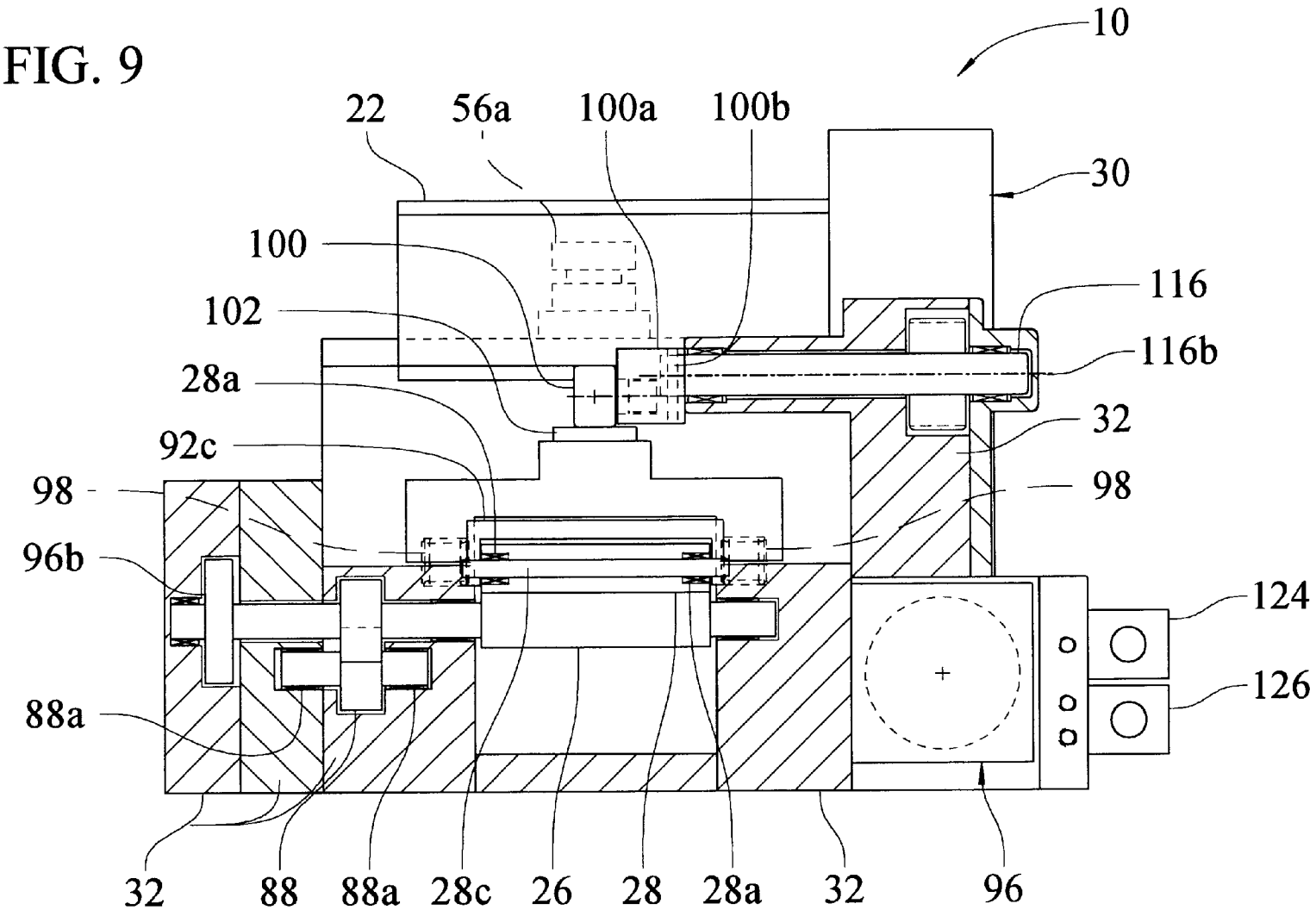
FIG. 9 is a view taken substantially along the line 9—9 of FIG. 3.
Figure 10:
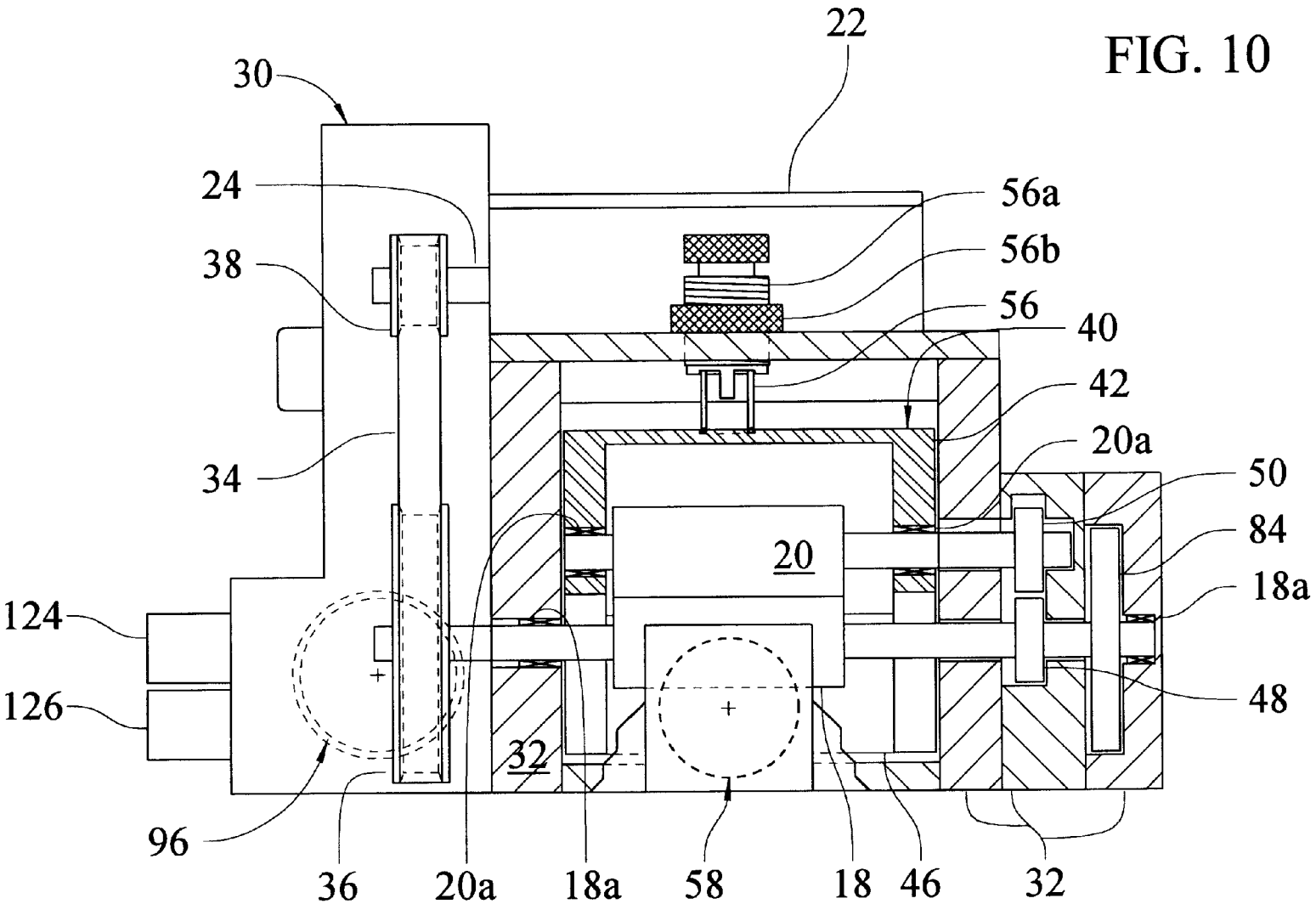
FIG. 10 is a downstream end view, with certain parts broken away and shown in cross-section.

The upper straightening rollers 28 are journaled in a platen 92 for free rotation about axes 28*b* (see FIGS. 1 and 9), and are journaled for limited pivoting with respect to the casing 30 toward and away from the lower straightening rollers. In this instance, the straightening rollers 28 are journaled on pins 28*a* connected to the sides of a bracket 92*c* carried by the platen, and the platen is pivotally mounted between the side supports 32 for pivoting about an axis 92*b* parallel to the feed path A—A proximate the upstream end thereof for swinging between (i) a lower position (FIG. 1)in which the upper straightening rollers are in straightening engagement with the strip material 16 located in the feed path, and (ii) a raised position (FIG. 2)in which the upper rollers are spaced from the strip material in the feed path. The axes 28*b* of the upper straightening rollers may be fixed in the platen 92, or the bracket 92*c* may be adapted for adjustment of the axes 28*b* such as disclosed in further detail in patent, U.S. Pat. No. 4,594,872 which is incorporated herein by reference. An entrance guide roller 94 provided upstream of the straightening rollers includes adjustable edge guides 94*a* (FIG. 3) to position the strip material 16 laterally between the side supports 32 as it feeds into the device 10.

The upper straightening rollers 28 are spring biased into their material release position, and pneumatically actuated to their material engaging-straightening position by a second pneumatic actuator 96. In this instance, a pair of laterally spaced springs 98 (see FIGS. 1 and 4) are positioned for acting between the casing 30 and the downstream end of the platen 92 to continuously bias the platen upwardly toward its raised position against a cam 100, and the actuator 96 is connected for actuation of the cam 100 (i) to effect movement of the platen from its raised position to its lower position in contravention to the resilient biasing force of the springs 98, and (ii) to permit rotation of the platen from its lower position to its raised position from the biasing action of the springs 98.

The cam 100 is carried by a drive shaft 116 that is journal mounted for pivoting about axis 116*b* above the downstream end of the platen 92 between first and second positions associated with the raised and lowered positions of the platen. The cam includes an operative surface portion that is off-set below axis 116*b* and that is positioned to slidably act against a hardened wear-plate 102 carried at the downstream end of the platen 92 such that pivoting of the cam about axis 116*b* causes the contact between the cam and the wear plate to lower and raise as shown in FIGS. 1 and 2, respectively. In the embodiment shown, the opposite end of the cam is threaded into a spacer 100*a* that is connected to the end of the shaft 116 with a pin 100*b* extending therethrough.

Figure 5:
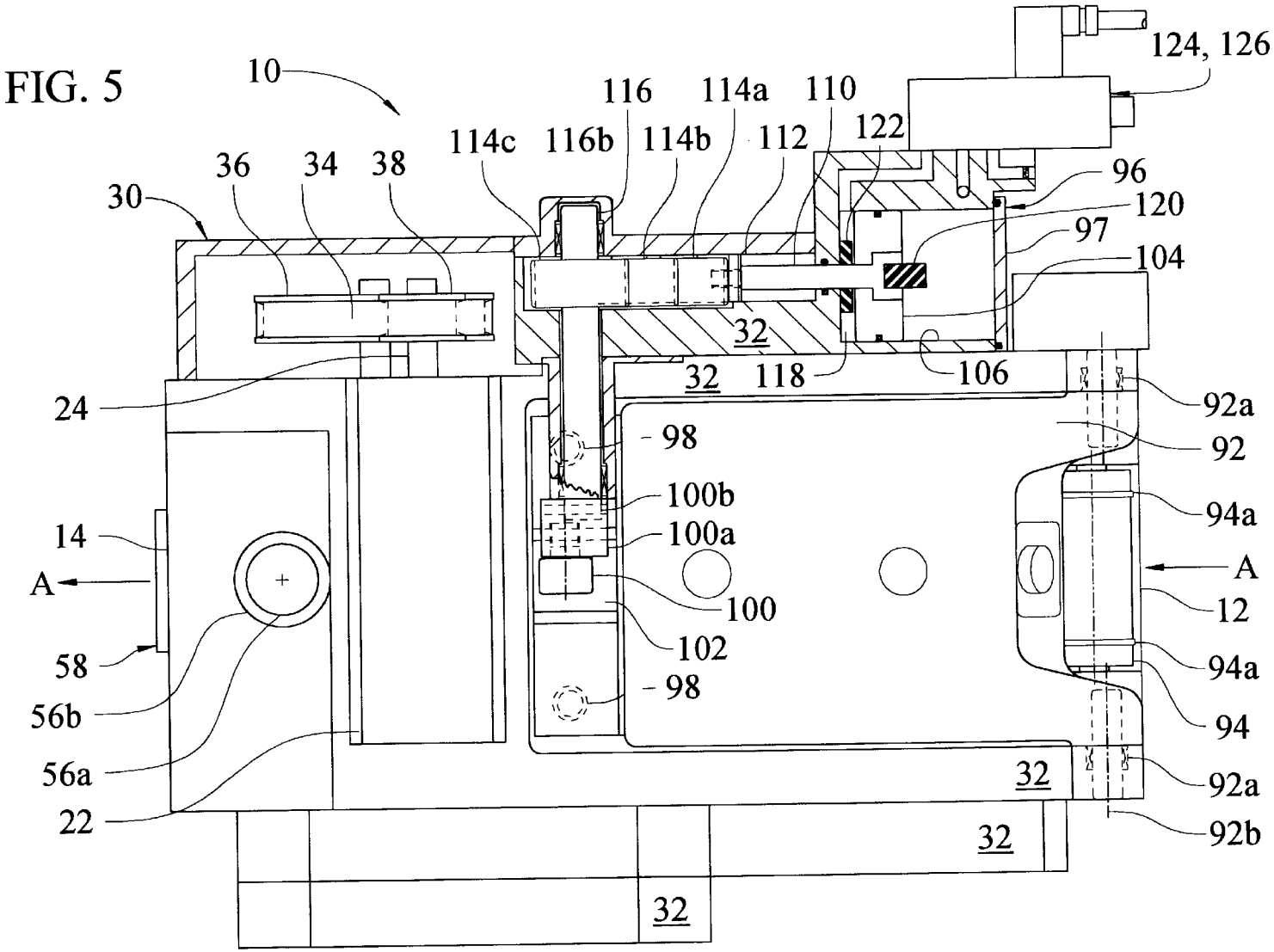
FIG. 5 is a top view with certain parts broken away and shown in cross-section, and with the apparatus shown in its material release condition.

The second pneumatic actuator 96 is constructed similar to actuator 58, and includes a pneumatically actuated piston 104 slidably located in a piston bore 106 defined within the casing 30 for linear movement between retracted and extended positions as shown in FIGS. 4 and 5, respectively, a low friction piston seal 108 positioned to establish a sliding, sealing engagement between the piston and the piston bore, and a piston rod 110 extending from the piston for linear movement therewith.

Figure 7:
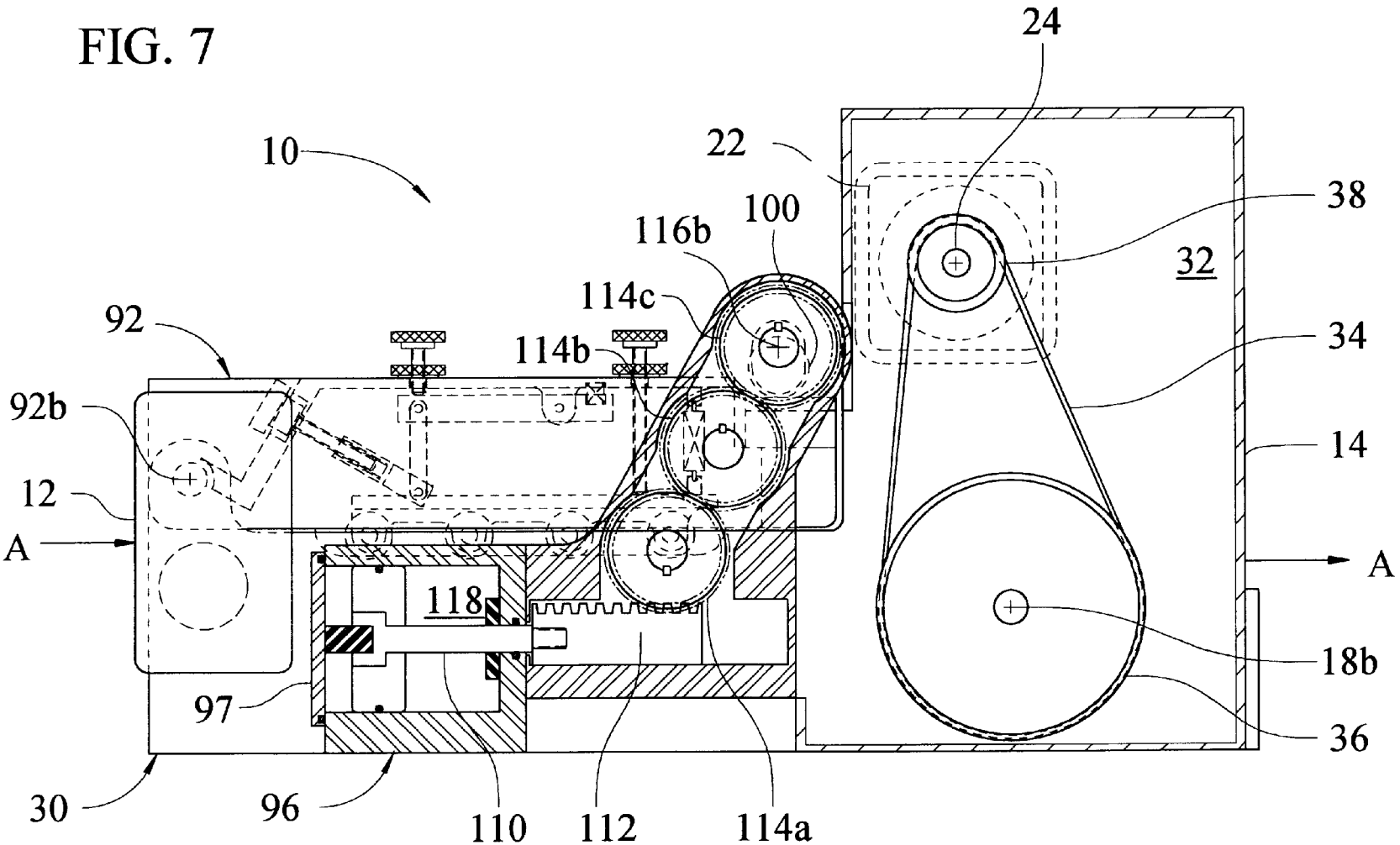
FIG. 7 is a right side view taken substantially along the line 7—7 of FIG. 3, with the apparatus shown in its material gripping condition.
Figure 8:
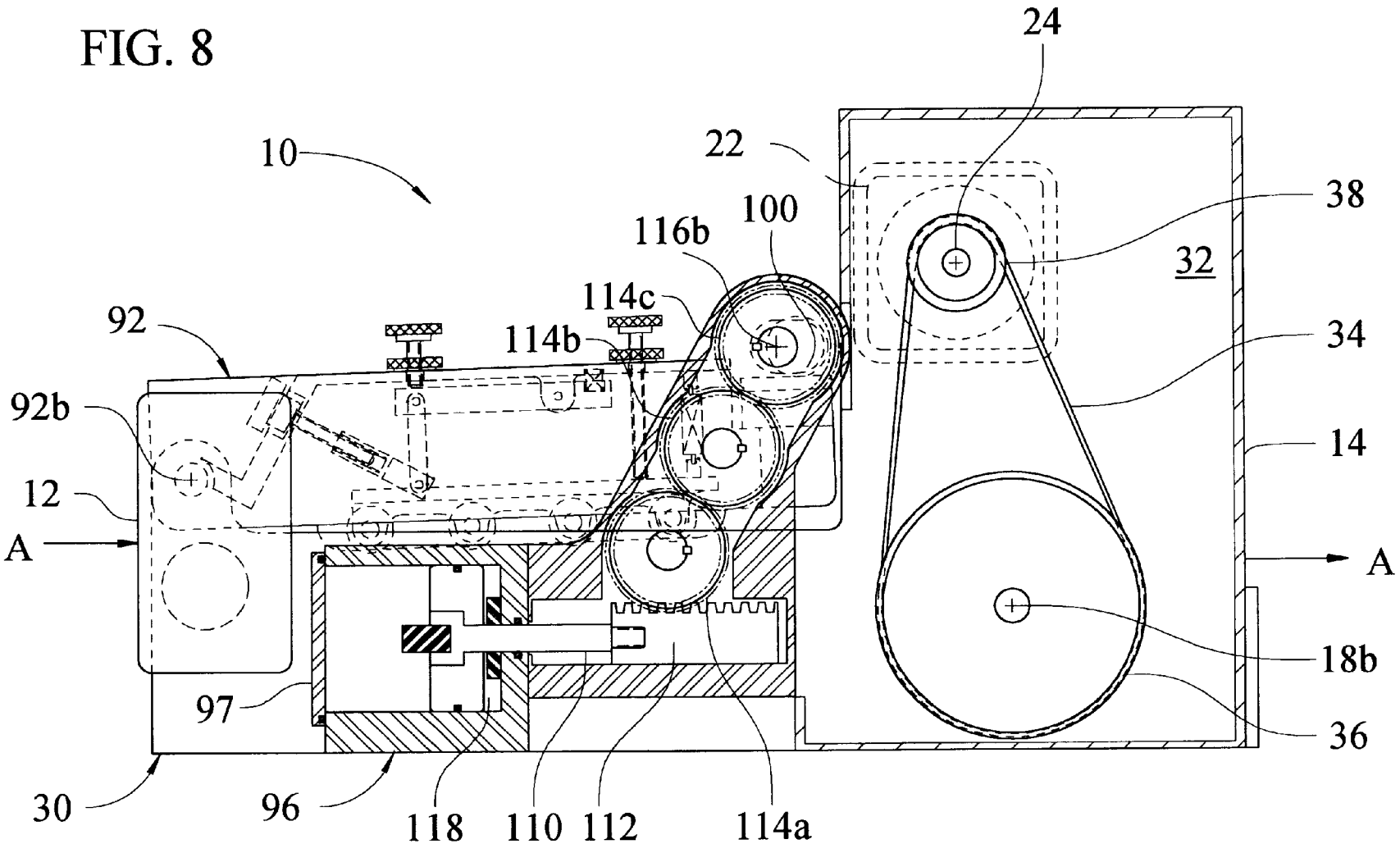
FIG. 8 is a view similar to FIG. 7, but with the apparatus shown in its material release condition.

In this instance, the piston rod 110 is coupled to a gear-toothed rack 112 for linear reciprocating movement as shown in FIGS. 7 and 8, and the rack drivingly engages a set of gears 114*a–c* to translate the linear piston motion into rotary motion. The upper gear 114*c* rotates about axis 116*b* and is connected to the cam 100 through the drive shaft 116.

With this arrangement, as air pressure is supplied to the chamber 118, the piston 104 strokes in the direction away from the rack 112 (to the left as shown in FIGS. 7 and 8), the rack moves with the piston and rotates the gears 114*a–c*, rotating the cam 100 toward its lowered position, until the rubber stop 120 engages against the actuator cap 97 as shown in FIG. 7. As the cam pivots downwardly, it acts against the upwardly biased wear plate 102 to drive the platen 92 downwardly to its lower position and the upper straightening rollers 28 to their material engaging-straightening position (FIG. 1).

As air pressure is relieved from the chamber 118, the bias force of springs 98 simultaneously raises the platen 92, and acting through the wear plate 102, rotate the cam 100 to their raised position (FIG. 2), and returns the piston 104 to its extended position (FIG. 8). A second rubber stop 122 is optionally provided to cushion the return stroke of the piston, and to reduce the volume of the chamber without affecting the pressure responsive area of the piston for relatively short actuator response time characteristics.

Synchronized pneumatic signals are provided to the actuators 58 and 96, to effect synchronized operation of the feed roller 20 and the straightening rollers 28, via synchronized operation of solenoid operated air pilot valves 124 and 126 that are pneumatically coupled to the actuators and electrically connected to receive control signals from a control unit 128.

Figure 11:
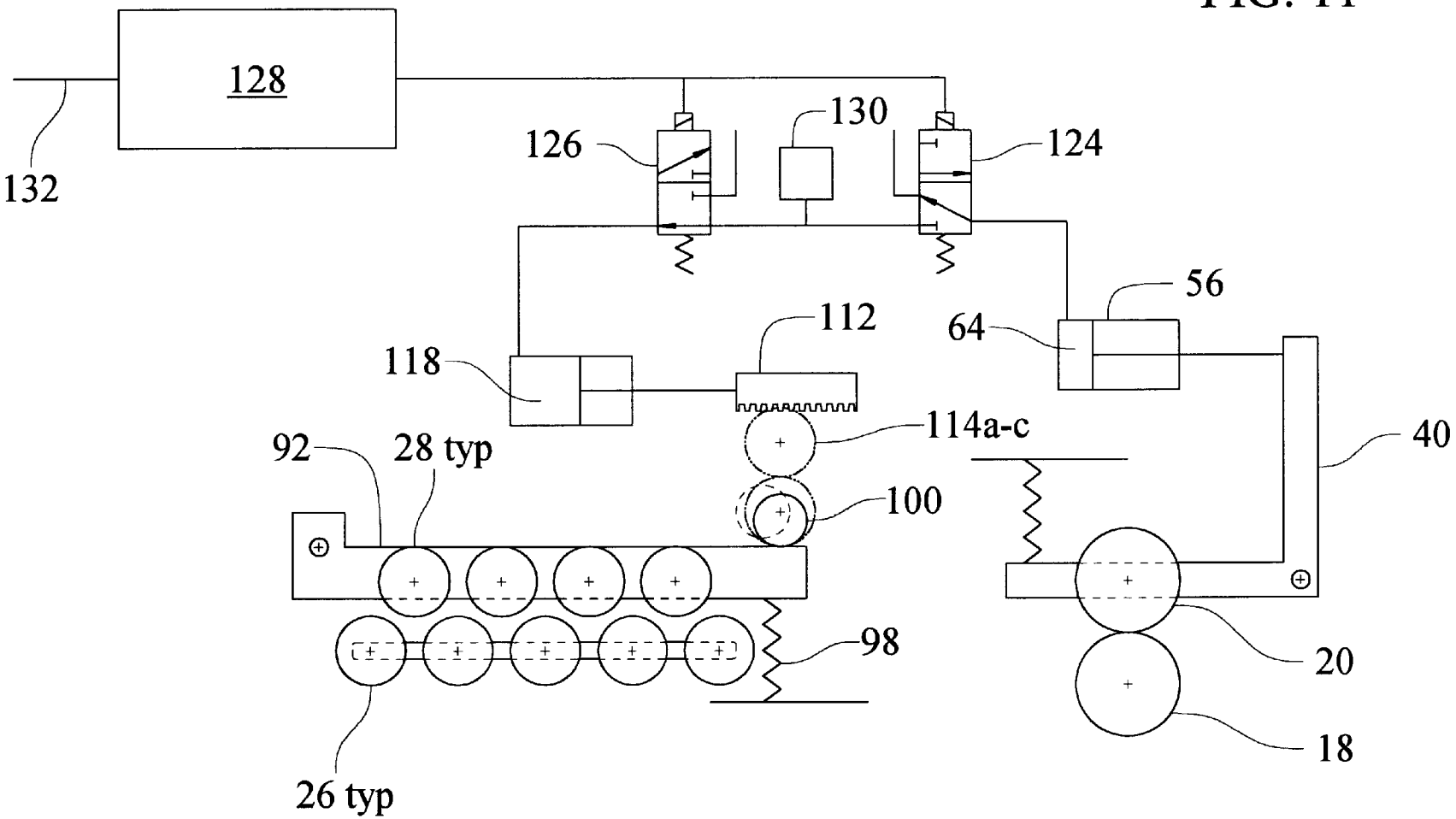
FIG. 11 is a schematic representation of certain fluidic and electrical components of the apparatus of FIG. 1 and showing said components in a material-feed condition.
Figure 12:
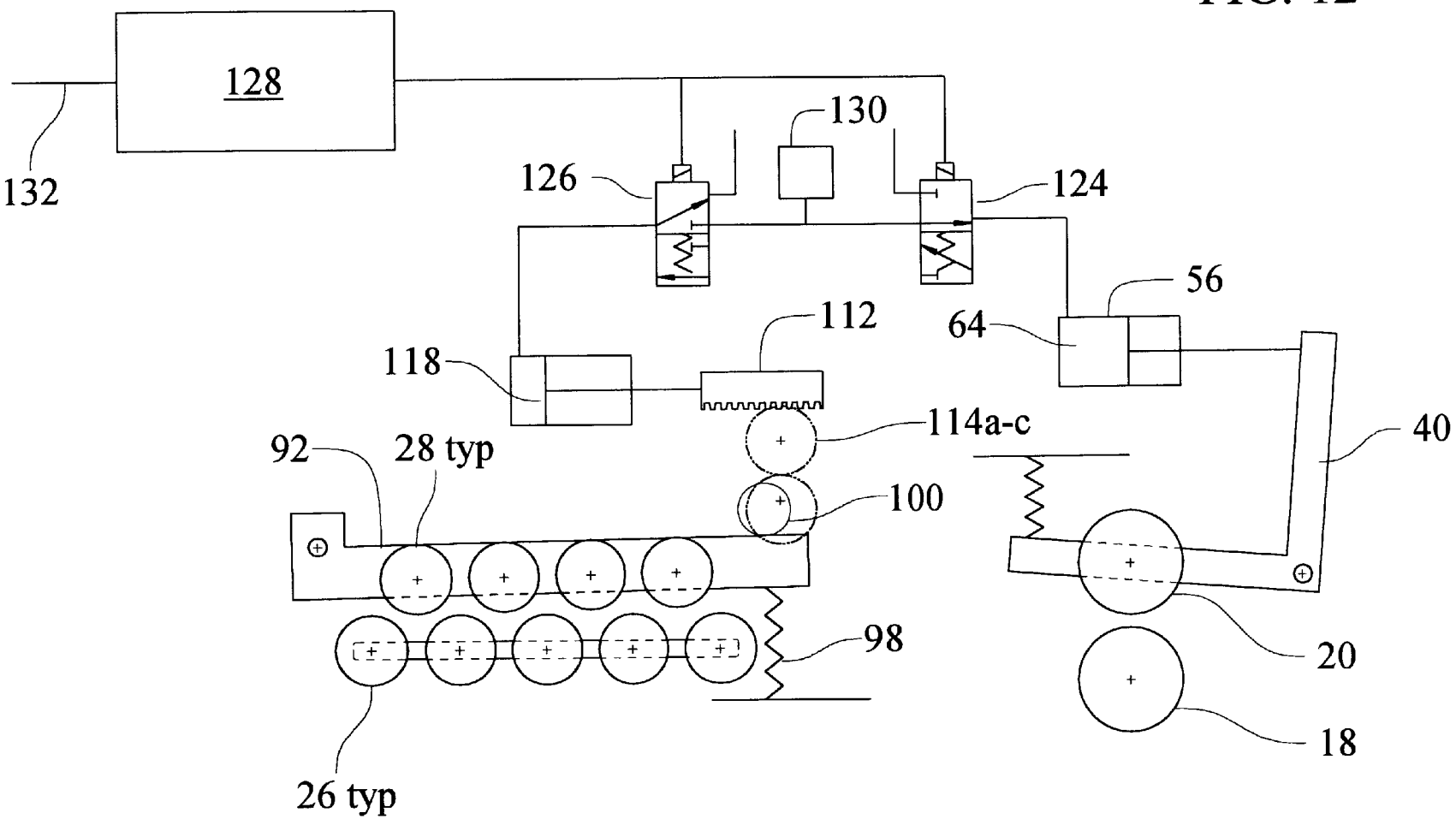
FIG. 12 is a schematic representation similar to FIG. 11 but showing said components in a material-release condition.

As shown in the schematic in FIG. 11, the pilot valve 124 is spring biased to a normally open position to vent chamber 64 of actuator 58 to atmosphere, and the pilot valve 126 is spring-biased to a normally closed position to establish fluid communication between chamber 118 of actuator 96 and a fluid pressure supply 130. Thus, absent an energizing control signal to the pilot valves 124 and 126, the spring 56 biases the feed roller 20 to its material gripping position, and the actuator 96 drives the cam 100 to its lower position and the upper straightening rollers 28 to their material straightening position, such that the device 10 is operative to simultaneously straighten the coil stock 16 and feed the straightened material to the punch press.

When the pilot valves 124 and 126 are energized, the valve 124 closes to establish communication between the chamber 64 and the pressure source 130, and the valve 126 opens to vent the chamber 118 to atmosphere. As discussed above, pressure to the chamber 64 causes the upper feed roller 20 to swing to its material release position, and the absence of pressure in chamber 118 allows the platen springs 98 to bias the upper straightening rollers 28 upwardly to their material release position.

Thus, simultaneously energizing and de-energizing the solenoid operated pilot valves 124 and 126 results in synchronized actuation of the feed rollers and the straightening rollers between their material engaging-gripping positions and material release positions.

An automatic control system operatively coupled between the combined material feed and straightening device 10 and the punch press is adapted to synchronize the feed and straightener operations of the device 10 with the material demand cycles of the punch press. Preferably, the control system includes a closed-loop, electronic control module 128 that is adapted to control the feed and straightening functions of a conventional material feed device, but modified to accomplish the feed and straightening synchronization functions of the present invention. Thus, the controller can be programmed with an integral or remote data entry keypad and associated programmable control module. The controller will be typically adapted for manual, single cycle, and automatic operating modes. And the controller can be provided with adjustable ramping speed and suitable fault diagnostics, as well as job memory, full batch and cumulative/cyclic counting functions.

To accomplish synchronized operation between the device 10 and the punch press, the controller receives signals 132 from the punch press indicating the start and end of the material demand cycles, and provides appropriate control signals to the pilot valves 124 and 126 in accordance herewith. In the embodiment described, when the controller receives a signal from the punch press indicating the start of a material demand cycle, the controller provides signals to simultaneously de-energize the solenoids of the pilot air valves such that the feed roller 20 and straightening rollers 28 simultaneously move to their material gripping-feeding and straightening positions, whereupon the power-rotated feed rollers draw the strip material through the straightening rollers, and advance the straightened stock toward the punch press. When the controller receives a signal from the press indicating a sufficient length of material has been provided and thus the demand for material has ended, the controller initiates signals to energize the pilot valves, whereupon the upper feed roller and the upper straightening rollers actuate to their material release positions and free the strip for final position in the press. Upon receiving the next material demand signal from the press, the controller simultaneously de-energized the pilot valves, and the upper feed roller and straightening rollers return to their material gripping-feeding and straightening positions without any loss in material roll position. This activity cycle is repeated for each operating cycle of the punch press.

Those skilled in the art will recognize that alternate arrangements are suitable for use in the invention hereof. For example, but without limitation, alternate arrangements will include the use of hydraulics to actuate the operators, dual-acting actuators rather than spring-biased actuators, and alternate biasing arrangements such as air springs. These and additional equivalents and alternate arrangements will fall within the scope of the present invention.

From the foregoing, it will be apparent that the present invention brings to the art a new and improved apparatus adapted to simultaneously straightening and feed strip material to a punch press or other using station. More particularly, the device is uniquely adapted to simultaneously release both the feed pressure and the straightening pressure on the strip material during a portion of each press cycle for ease of final positioning in the press, or for other using station purposes, and to simultaneously reset and regrip the strip material, to reapply the feed pressure and straightening pressure to the material for advancing and simultaneously straightening the next length of stock to the press.

I claim:

1. A combined material straightening and feed apparatus advance strip stock to a using station in synchronization with the operating cycles of the using station, the apparatus comprising:

a) a first feed roll journaled for rotation about a first axis, b) a second feed roll journaled for rotation about a second axis parallel to the first axis and for swinging between first and second material-advancing positions, toward and away from the first feed roll, respectively, c) a first operator operably connected to move the second feed roll between said material-advancing positions, d) a first set of straightening rolls journaled for rotation about a first set of axes parallel to said first axis, e) a second set of straightening rolls journaled for rotation about a second set of axes parallel to the first set of axes and for swinging between first and second material-straightening positions, toward and away from the first set of straightening rollers, respectively, independently of the swinging of the second feed roll, f) a second operator operably connected to move the second set of straightening rolls between said material-straightening positions, and g) control apparatus connected to the operators for effecting synchronized movement of said second feed roll and said second set of straightening rolls between said first and second associated positions.

2. The apparatus of claim 1 further comprising a frame and first and second brackets, the second feed roll and the second set of straightening rolls being journaled for said rotation in the first and second brackets, respectively, and the first and second brackets being connected to the frame for movement of said second feed roll and said second set of straightening rolls between said first and second associated positions.

3. The apparatus of claim 2 in which said first and second brackets are journaled in the frame about third and fourth axes parallel to said first axis for swinging of the second feed roll and the second set of straightening rolls between said associated positions.

4. The apparatus of claim 1 in which (i) said second feed roll and said second set of straightening rolls are biased into one of said associated positions, and (ii) said first and second operators comprise first and second piston actuators connected for synchronized movement of said second feed roll and said second set of straightening rolls to the other of said associated positions.

5. The apparatus of claim 4 in which said first and second operators further comprise first and second pilot valves communicating with said actuators and operative to actuate said actuators to effect said synchronized movement of the second feed roll and the second set of straightening rolls.

6. The apparatus as defined in claim 1 in which said second feed roll is biased towards said first material-advancing position, and said second set of straightening rolls is biased towards said second material-straightening position.

7. The apparatus as defined in claim 3 in which said second set of straightening rolls are spring biased towards said second material-straightening position and thus away from said first set of straightening rolls, and said second operator includes a cam surface rotatable for engaging and actuating said second bracket from said second material-straightening position to said first material-straightening position.

8. An combined material straightening and/feed apparatus to advance strip stock to a using station in synchronization with the operating cycles of the using station, the apparatus comprising:

a) a frame, b) a first feed roll and a first set of straightening rolls journaled for rotation in the frame, c) first and second brackets pivotally mounted to the frame, d) a second feed roll and a second set of straightening rolls journaled for rotation in the first and second brackets, respectively, the first bracket being positioned for swinging the second feed roll between first and second material-feed positions, toward and away from the first feed roll, respectively, and the second bracket being positioned for swinging the second set of straightening rolls between first and second material-straightening positions, toward and away from the first set of straightening rolls, respectively, the first and second brackets being mounted for biasing the second feed roll and the second set of straightening rolls to one of said associated material-advancing and material-straightening positions, respectively, e) a drive unit connected for power rotation of one of said feed rolls for intermittently advancing stock positioned between the feed rolls when the second feed roll is in said first material-feed position, f) first and second pressure-responsive actuators connected between the frame and the first and second brackets, respectively, the actuators being actuatable to swing the second feed roll and the second set of straightening rolls to the other of said associated material-feed and material-straightening positions, respectively, and g) first and second pilot values connected to said first and second actuators and operative to provide pressure-signals thereto for actuation of the second feed roll and the second set of straightening rolls to the other of said associated positions.

9. The apparatus as defined in claim 8 in which the first and second brackets are pivotally mounted to the frame for swinging said second feed roll and said second set of straightening rolls about first and second parallel axes, respectively, and said apparatus further comprises an idler drive member rotatable about said first axis and rotatably connecting the feed rolls when the second feed roll is in said first material-feed position such that the drive unit power rotates both feed rolls when the second feed roll is in said first material-feed position.

10. A combined material straightening and feed apparatus to advance strip stock to a using station in synchronization with the operating cycles of the using station, the apparatus comprising:

a) a first feed roll journaled for rotation about a first axis, b) a second feed roll journaled for rotation about a second axis parallel to the first axis and for swinging between first and second material-advancing positions, toward and away from the first feed roll, respectively, c) a first operator operably connected to move the second feed roll between said material advancing positions, d) a first set of straightening rolls journaled for rotation about a first set of axes parallel to and upstream of said first axis, e) a second set of straightening rolls journaled for rotation about a second set of axes parallel to the first set of axes and for swinging between first and second material-straightening positions, toward and away from the first set of straightening rollers, respectively, f) a second operator operably connected to move the second set of straightening rolls between said material-straightening positions, g) a drive unit connected for power rotation of one of said feed rolls and advancing stock positioned between the feed rolls when the second feed roll is in said first material-feed position, and h) a control module (1) responsive to a control input signal indicative of the operating cycles of the using station, and (2) connected to control the operators and drive unit in response thereto for effecting synchronized movement of said second feed roll and said second set of straightening rolls between said first and second associated positions, and for effecting controlled power rotation of said one feed roll, with the operating cycles of the using station.

11. The apparatus as defined in claim 10 in which said drive unit is operative to provide a feedback signal indicative of the position of said one feed roll, and said control module includes closed-loop control responsive to skid position feedback signal.

12. The apparatus as defined in claim 10 in which said control module includes a programmable input module for esablishing operating and control parameters of the first and second operators and the drive unit.

13. A combined material straightening and feed apparatus to advance strip stock to a using station in synchronization with the operating cycles of the using station, the apparatus comprising:

a) a first feed roll journaled for rotation about a first axis, b) a second feed roll journaled for rotation about a second axis parallel to the first axis and for swinging between first and second material-advancing positions, toward and away from the first feed roll, respectively, c) a first operator operable to move the second feed roll between said material-advancing positions, d) a first set of straightening rolls journaled for rotation about a first set of axes parallel to said first axis, e) a second set of straightening rolls journaled for rotation about a second set of axes parallel to the first set of axes and for swinging between first and second material-straightening positions, toward and away from the first set of straightening rollers, respectively, said second set of straightening rolls being further mounted for vertical, horizontal, and angular adjustment with respect to said first material-straightening position, f) a second operator operable to move the second set of straightening rolls between said material-straightening positions, and g) control apparatus connected to the operators for synchronized movement of said second feed roll and said second set of straightening rolls between said first and second associated positions.

* * * * *